US005430346A

United States Patent [19]

Johnson

[11] Patent Number: 5,430,346

[45] **Date of Patent: * Jul. 4, 1995**

[54] SPARK PLUG WITH A GROUND ELECTRODE CONCENTRICALLY DISPOSED TO A CENTRAL ELECTRODE AND HAVING PRECIOUS METAL ON FIRING SURFACES

[75] Inventor: James E. Johnson, Clearwater, Fla.

[73] Assignee: Ultra Performance International, Inc., Largo, Fla.

[ * ] Notice: The portion of the term of this patent subsequent to Jan. 18, 2011 has been disclaimed.

[21] Appl. No.: 149,367

[22] Filed: Nov. 9, 1993

Related U.S. Application Data

[63] Continuation-in-part of Ser. No. 20,099, Feb. 19, 1993, Pat. No. 5,280,214, which is a continuation of Ser. No. 644,993, Jan. 23, 1991, abandoned, which is a continuation-in-part of Ser. No. 421,172, Oct. 13, 1989, abandoned.

[51] Int. Cl.[6] ..... H01T 1/22

[52] U.S. Cl. ..... 313/139; 313/141

[58] Field of Search ..... 313/139, 140, 141, 142, 313/143

[56] References Cited

U.S. PATENT DOCUMENTS

| | | | |
|---|---|---|---|
| 2,487,535 | 11/1949 | Fernandez . | |
| 2,894,162 | 7/1959 | Ignatjev | 313/141 |
| 4,268,774 | 5/1981 | Forkum | 313/141 |
| 4,465,952 | 8/1984 | Sato et al. | 313/136 |
| 4,670,684 | 6/1987 | Kagawa et al. | 313/141 |
| 5,280,214 | 1/1994 | Johnson | 313/139 |

*Primary Examiner*—Donald J. Yusko
*Assistant Examiner*—Michael Day
*Attorney, Agent, or Firm*—Herbert W. Larson

[57] ABSTRACT

A spark plug for an internal combustion engine wherein a ring shaped ground electrode has a uniform annular hole with an internal diameter about 0.80 to 1.25 times the outer diameter of the center electrode. The ground electrode is vertically spaced below the center electrode and is concentric therewith. The ground electrode is connected to one or more mounting posts attached to a spark plug metal housing. Firing surfaces of the ground and center electrode have platinum alloy inserts laser welded in place. The spark from the center electrode to the ground electrode has multiple paths and results in a spark plug which improves fuel combustion, increases gasoline mileage and engine horsepower and torque and significantly reduces the smolder time or ignition delay time and consequently reduces environmental pollutants of nitrogen oxide, carbon monoxide and other hydrocarbons.

10 Claims, 5 Drawing Sheets

SPARK PLUG WITH A GROUND ELECTRODE CONCENTRICALLY DISPOSED TO A CENTRAL ELECTRODE AND HAVING PRECIOUS METAL ON FIRING SURFACES

PRIOR APPLICATIONS

This application is a divisional continuation-in-part of application Ser. No. 08/020,099, filed Feb. 19, 1993, now U.S. Pat. No. 5,280,214, which is a continuation of application Ser. No. 07/644,993, filed Jan. 23, 1991, now abandoned, which is a continuation-in-part of application Ser. No. 07/421,172, filed Oct. 13, 1989, now abandoned.

FIELD OF THE INVENTION

This invention relates to spark plugs used in internal combustion engines. More particularly, it refers to an improved spark plug having a ground electrode with a ring or ring segment internal opening concentrically disposed with respect to a center electrode and a precious metal laser welded insert on the ground electrode and center electrode firing surfaces.

DESCRIPTION OF THE PRIOR ART

Commercial internal combustion engine spark plugs in current wide spread use have characteristicly had a center electrode with an exposed end in its base that is spaced apart from a ground electrode. The ground electrode is usually an L shaped single arm welded to an edge of the plug and bent over towards the center electrode at substantially a right angle. Although these plugs work satisfactorily, it has been determined that their design substantially detracts from a complete burn cycle in an internal combustion engine's combustion chamber and results in the overheating of plug parts, incomplete combustion and the production of oxides of nitrogen in the combustion chamber.

Attempts at improving plug firing and achieving a more complete combustion chamber burn has received little research effort compared to other methods of reducing oxides of nitrogen automotive emissions. U.S. Pat. No. 2,487,535 describes an annular tapered curved fork as a spark plug ground electrode for the purpose of "conducting excessive heat away". Column 1, lines 50–51. The central electrode terminates in a position on a plane with the ground electrode so that the spark is substantially perpendicular to the longitudinal axis of the spark plug. Such a spark geometry does not provide for a large surface area to promote active combustion.

U.S. Pat. Nos. 2,894,162 and 4,268,774 describe ground electrodes having diverging prongs. Such a configuration increases the spark surface area and improves combustion chamber burning. U.S. Pat. No. 4,670,684 describes a spark plug with a central and ground electrode made of a nickel-base alloy. A chip of a platinum nickel alloy is joined to opposing spark discharge surfaces of the electrodes. However, substantial further improvement could be made over the prior art spark plugs in burning efficiency in the combustion chamber due to spark generation.

SUMMARY OF THE INVENTION

I have invented a spark plug with an improved ground electrode which greatly reduces ignition delay time and, even under high compression, generates significantly increased spark between the ground electrode and central electrode to thereby increase burning efficiency in the combustion chamber and result in increased engine horsepower and torque, reduced rates of fuel consumption, reduced oxides of nitrogen and hydrocarbon emissions and provides extended spark plug performance.

As used hereinafter, the term "ring shaped" ground electrode includes such ground electrodes having an open inner annular uniform circumference from about 270 to 360 degrees and the diameter of the opening being about 0.80 to 1.25 times the outer diameter of a central electrode with which it is concentrically disposed. The outer shape of the ground electrode may be annular, square, rectangular, oblong or other geometric configuration.

My invention is the discovery that a ring shaped ground electrode mounted to at least one mounting post by way of a mounting ring, or directly welded, crimped or otherwise electrically attached to a spark plug housing, produces multiple spark arcs around the inner surface of the ground electrode from the central electrode. The preferred embodiment of my ring shaped electrode has an interior uniform diameter ranging from about one to about one and one tenth the exterior diameter of the central electrode and is concentric or co-axial with the central electrode. Most preferred is an interior diameter of about 0.015 of an inch larger than the exterior diameter of the central electrode. The terminal end of the central electrode is typically vertically spaced about 0.030 to 0.060 inch or 0.76 to 1.152 mm from a bottom surface of the ground electrode to define a spark gap. The low angle multiple sparks produced by my ring shaped electrode greatly reduces smolder, or ignition delay time and results in a more complete fuel burning in the combustion chamber to thereby increase engine horsepower and mileage per liter of fuel consumed, together with a reduction of oxides Of nitrogen and hydrocarbon emissions from the engine exhaust system. The spark pattern is maintained even under very high compression where other spark plugs cease all except sporadic firing.

A most preferred embodiment of my ring shaped electrode uses a ground and center electrode firing surface at least partially covered with a platinum alloy or related precious metal alloy. The platinum alloy is in the form of an insert bonded or fused to the opposed firing surfaces of the ring shaped ground electrode and the center electrode.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
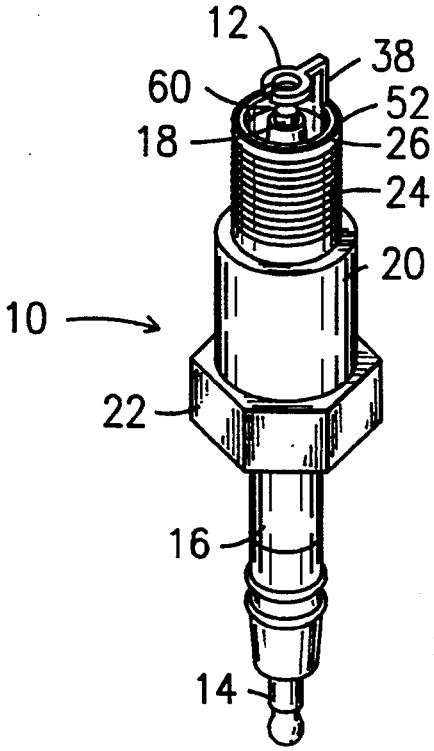
FIG. 1 is an isometric view of a ring shaped ground electrode in the spark plug of this invention where the ring is open.

Throughout the following detailed description, the same reference numerals refer to the same elements in all figures. The spark plug has been shown in a base-up position in the drawings for ease of description. However, the base is considered in its usual lower position for purposes of the description that follows.

Spark plug 10 shown in FIG. 1 is a conventional internal combustion engine spark plug except for the ring shaped ground electrode 12 substituted for the L shaped ground electrode typically seen in conventional spark plugs. The spark plug 10 shown in FIG. 1 has a terminal element 14 connected to a coil wire (not shown). A high quality insulator such as a ceramic material 16 encapsulates a central electrode which terminates at the bottom of the spark plug 10 as exposed central electrode 18 in the form of a solid cylinder. The ceramic material could be substituted with a high temperature resistant copolymer. The bottom portion of the spark plug 10 has a metal shell 20 and a nut portion 22. The shell 20 terminates in a shank 24 which has a shank skirt 26. The interior portion of the shank 24 is in the shape of a cup 28. The center electrode 18 is located in the center of the cup 28. In addition, the interior surface of the shank skirt 26 has an inwardly protruding annular shelf 30.

The ring shaped ground electrode 12 of my invention has an annular open center and is supported by one to four mounting posts 38. The ring 12 can have a gap up to 90° or be closed 12A as shown in FIGS. 13–23. Mounting posts 38 are attached at a first end 40 to a right angled beam 31 or a slanted member 32 and at a second end 42 to a mounting ring 44.

The inside diameter of the ring shaped ground electrode 12 is uniform around the ring and ranges from 0.80 to 1.25 times the diameter of the center electrode 18. In addition, the inner circumference of the ground electrode 12 is concentric with respect to center electrode 18.

Figure 6:
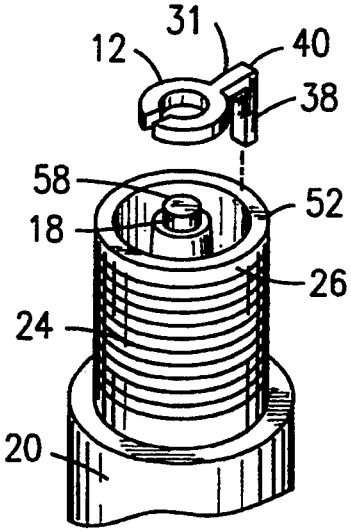
FIG. 6 is an exploded view of an alternate ground electrode component in relation to a spark plug cup.
Figure 7:
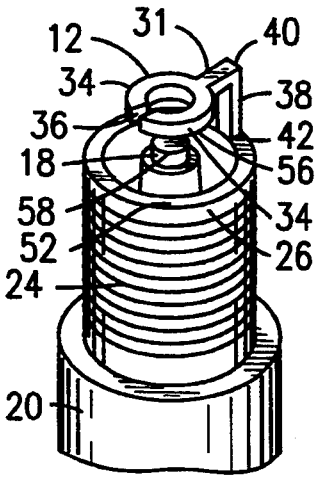
FIG. 7 is an isometric view of the ground electrode component of FIG. 6 bonded in place.
Figure 8:
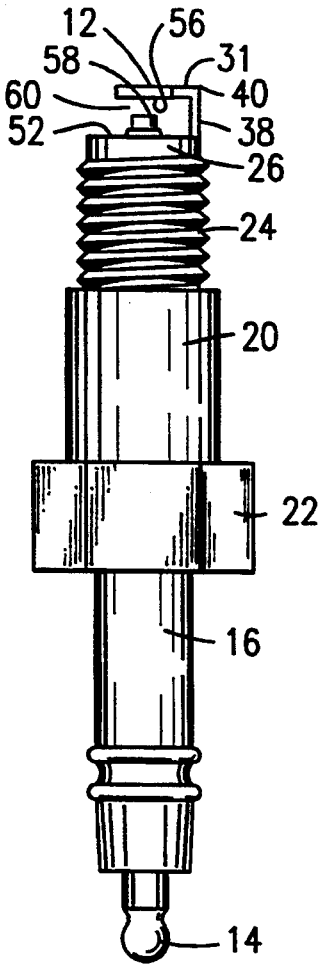
FIG. 8 is an elevation view of the spark plug of the invention.
Figure 18:
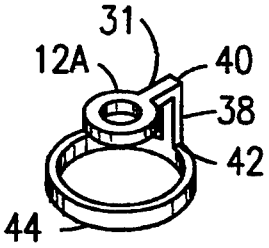
FIG. 18 is an isometric view of an embodiment of the ring shaped ground electrode component.
Figure 21:
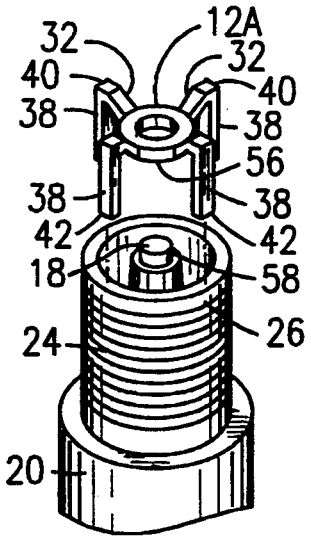
FIG. 21 is an exploded view of one embodiment of the ring shaped ground electrode component without a mounting ring shown in relation to a spark plug cup.
Figure 19:
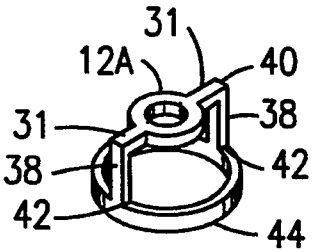
FIG. 19 is an isometric view of another embodiment of the ring shaped ground electrode component.
Figure 20:
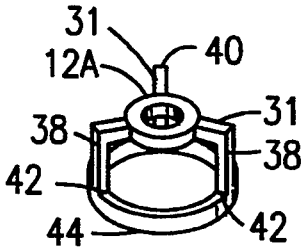
FIG. 20 is an isometric view of yet another embodiment of the ring shaped ground electrode component.
Figure 22:
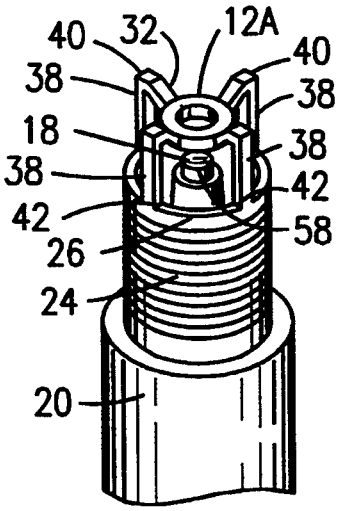
FIG. 22 is an isometric view of the ring shaped ground electrode component of FIG. 21 bonded to the spark plug metal skirt.
Figure 23:
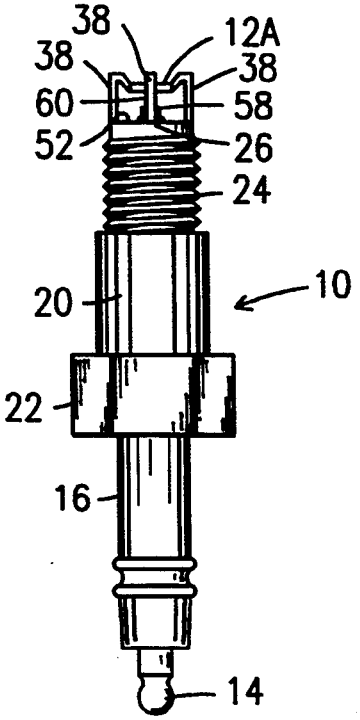
FIG. 23 is a side elevation view of the ground electrode of FIG. 20 bonded to a spark plug.
Figure 24:
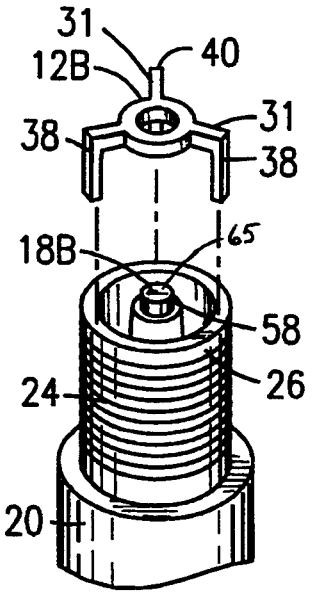
FIG. 24 is a perspective view of a spark plug containing a platinum alloy insert bonded on each firing surface of the ground and center electrode.
Figure 25:
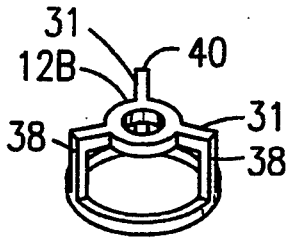
FIG. 25 is a perspective view of an alternative ground electrode containing a platinum alloy firing surface.
Figure 27:
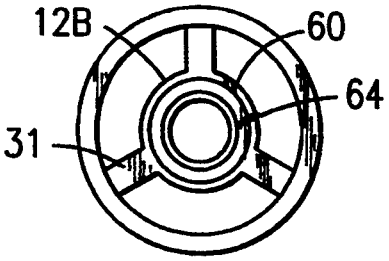
FIG. 27 is a firing surface plan view of the ground electrode of FIG. 25.

Beam 31 or slanted member 32 connect the first end or bottom 40 of mounting post 38 to the ring shaped ground electrode 12. In the case of slanted member 32 the ring 12 is on a plane higher than the bottom 40 of each mounting post 38. In the case of beam 31 there is a sharp right angle with respect to post 38 so the ring 12 is on the same plane with the bottom 40 of each mounting post 38. A single post 38 as seen in the embodiment of FIGS. 6 and 18, double posts 38 as seen in FIGS. 7 and 19, triple posts 38 as seen in FIGS. 8 and 20, or four posts 38 as seen in FIGS. 21 and 22 can be used to support the ring electrode 12 or 12A.

In constructing the spark plug 10 of my invention the ground electrode component 46 or 46A consisting of the mounting ring 44, the mounting post 38 and the ring shaped electrode 12 or 12A is preferably cast, stamped, cut or formed from a high quality metal such as a nickel alloy having in excess of 90% nickel, platinum alloy or the like. Conventional laser welding, brazing or other fusion or bonding of the support post 38 to the housing can be employed in place of the use of a mounting ring.

Figure 2:
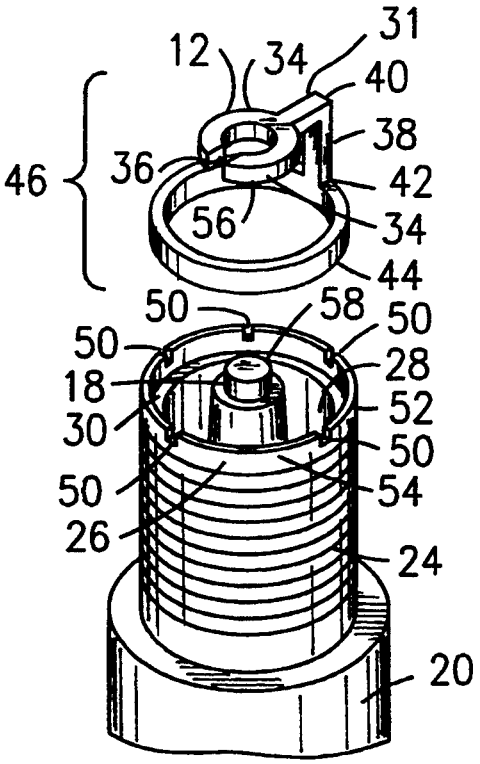
FIG. 2 is an exploded view of the ground electrode component in relation to the bottom of the spark plug.
Figure 3:
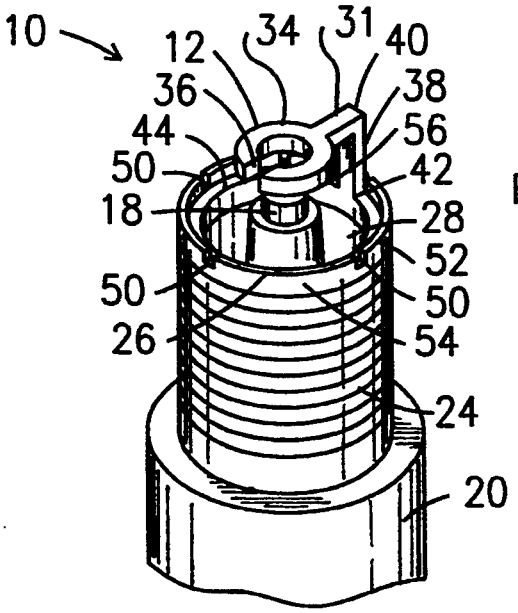
FIG. 3 is an isometric view of the ground electrode mounted within a spark plug cup.
Figure 4:
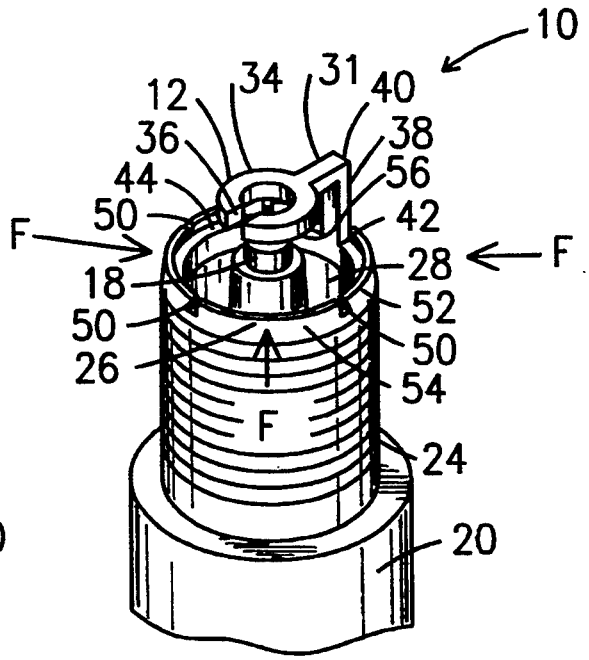
FIG. 4 is an isometric view of the ground electrode in the spark plug cup showing a method of locking the ground electrode in place.
Figure 5:
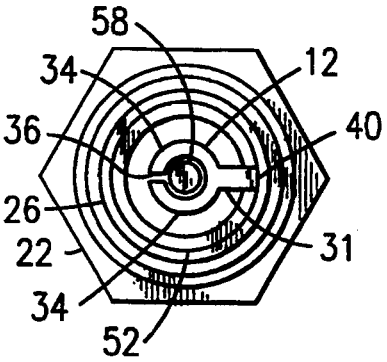
FIG. 5 is a bottom plan view of the spark plug.
Figure 14:
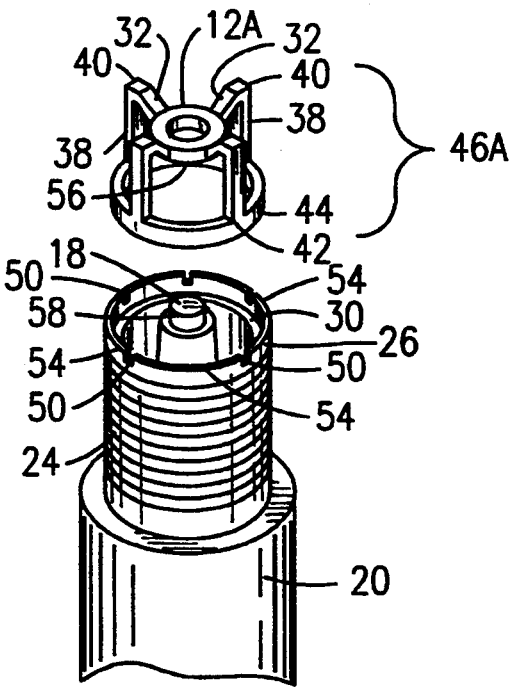
FIG. 14 is an exploded view of the ring shaped ground electrode component of FIG. 13 in relation to the bottom of the spark plug.
Figure 15:
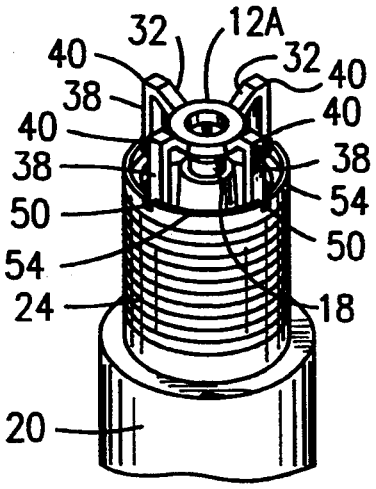
FIG. 15 is an isometric view of the ring shaped ground electrode of FIG. 13 mounted within a spark plug cup.
Figure 16:
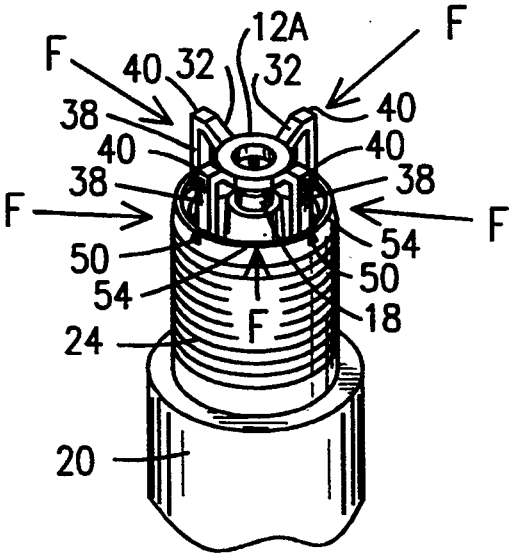
FIG. 16 is an isometric view of the same ring shaped ground electrode of FIG. 15 in the spark plug cup showing a method of locking the ground electrode in place.
Figure 17:
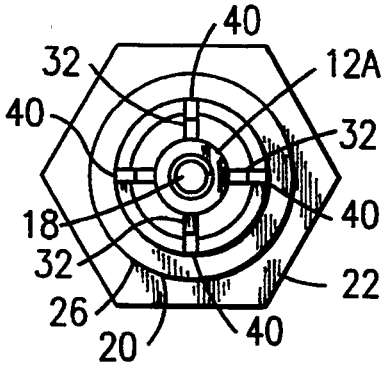
FIG. 17 is a bottom plan view of the same spark plug as shown in FIGS. 13–16.

The ground electrode component 46 or 46A is placed on top of shelf 30 as shown in FIGS. 2 and 14 respectively with the spark plug 10 in an inverted position. Vertical notches 50 are cut in the edge 52 of shank skirt 26. The metal sections 54 between notches 50 are bent or crimped as shown by force arrow F in FIGS. 4 and 16, over the mounting ring 44 to insure a fixed mounting position of the component 46 within the cup 28 of the spark plug 10.

Figure 11:
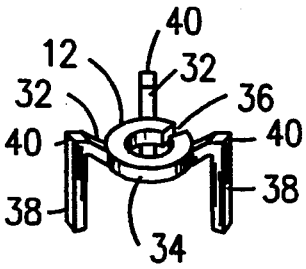
FIG. 11 is an isometric view of the ground electrode of FIG. 9 with three support arms instead of the ring base.
Figure 12:
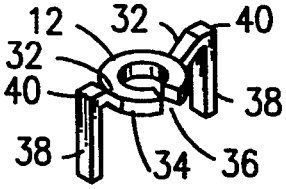
FIG. 12 is an isometric view of the ground electrode of FIG. 9 with two support arms instead of the ring base.
Figure 13:
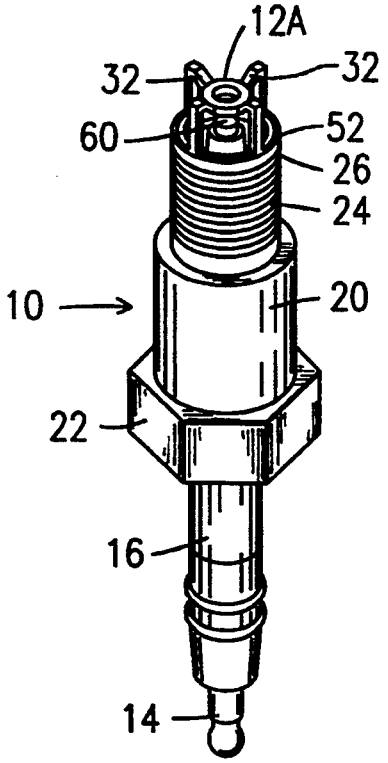
FIG. 13 is an isometric view of an alternative embodiment of a ring shaped ground electrode in the spark plug of this invention.

The distance 60 between the ground electrode 12 or 12A top surface 56 and the bottom surface 58 of center electrode 18 typically is about 0.030 to 0.060 inch or 0.76 to 1.152 mm. See FIG. 11. Greater or lesser spacing may be required for combustion chambers of unusual design or fuels substituted for gasoline such as propane, methanol, ethanol, methane or natural gas.

Upon spark emission, the electrical spark moves from the center electrode 18 along the top surface 56 of electrode 12 or 12A. The angle of the spark from electrode 18 to the top surface 56 of electrode 12 or 12A is less than 30 degrees and preferably is less than fifteen degrees from the longitudinal axis of the spark plug. The ring shaped ground electrode 12 of my invention generates an enhanced spark pattern which significantly increases the performance and efficiency of internal combustion engines and reduces the smolder, or ignition delay time to result in more complete combustion of the fuel mixture, thereby improving the combustion flame spread around the periphery of the ground electrode. Such a uniform flame spread produces up to twenty percent added horsepower for a given amount of fuel consumed and approximately three to six miles per gallon increased fuel economy. In addition, there is a reduction of twenty-five to thirty-five percent in hydrocarbons and a significant reduction in carbon monoxide, and oxides of nitrogen in the exhaust gasses. As a further advantage, and of great significance, the ignition delay time, of combustion chamber smolder time, is reduced by more than 50% and the spark plug life is at least doubled over a conventional spark plug since the distribution of the spark along surface 56 prevents the single point type burn which occurs on a conventional ground electrode. In addition, the present configuration continues to fire in substantially the same firing pattern at very high compression where other spark plugs cease all but sporadic firing.

By casting the electrode component 46, greater variability in the metal usage can be achieved to obtain the optimum longevity of the ground electrode 12. Alternatively, the electrode component 46 can be stamped, machined or formed from a piece of suitable electrode metal. The electrode component 46 is placed on shelf 30 and the metal sections 54 are bent over to crimp the mounting ring 44 and thereby hold the electrode component 46 in place. If the mounting ring 44 is not employed, then each mounting post 38 may be fused or otherwise connected to edge 52 as is well known in the art.

Figure 9:
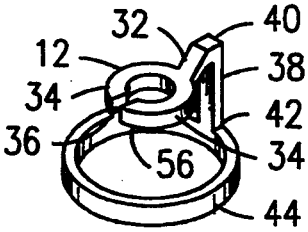
FIG. 9 is an isometric view of an embodiment of the ground electrode with a ring base.
Figure 10:
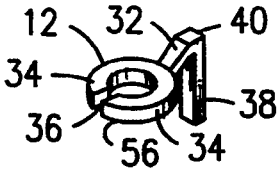
FIG. 10 is an isometric view of the ground electrode of FIG. 9 without the ring base.

An alternative embodiment of my invention is shown in FIGS. 9 and 10 wherein the mounting ring 44 is not used and the ground electrode 12, integral with mounting posts 38, is welded or otherwise connected to the edge 52 of a spark plug skirt 26 at the second end 42.

In the ring shaped ground electrode 12 shown in FIGS. 1–12 the discontinuity or gap 36 in the ring is less than 90° between arms 34. Preferably, the gap is about 0.015" to 0.098 inch or 0.38 to 2.5 mm and the ends of the arms 34 forming gap 36 are parallel to each other.

Figure 28:
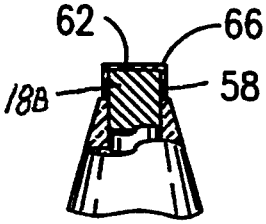
FIG. 28 is a side elevation view of a center electrode with a platinum alloy layer bonded to the firing end.
Figure 26:
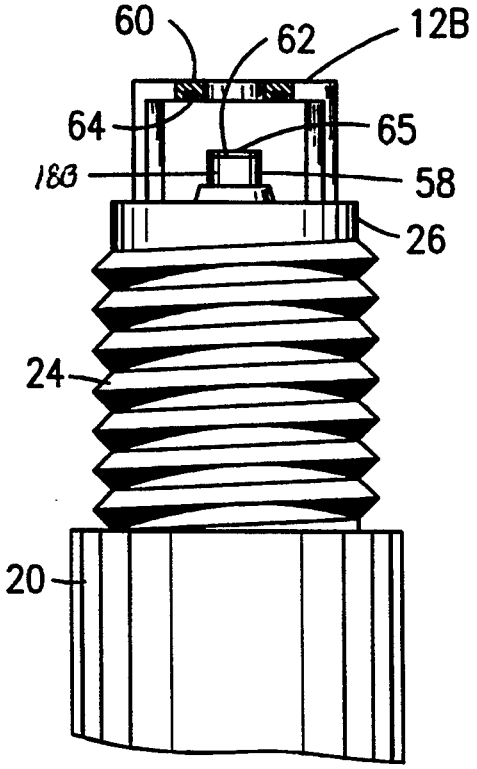
FIG. 26 is an enlarged side elevational view of a spark plug containing a platinum alloy insert bonded on each firing surface of the ground and center electrode.

A most preferred spark plug of my invention shown in FIGS. 24–28, contains on the firing surface 60 of the ground electrode 12B and firing surface 62 of the center electrode 18B a precious metal insert 64 and 65 respectively. Such precious metal insert is defined as an insert containing platinum, platinum and iridium alloy or other alloy of platinum, or palladium, iridium or an alloy thereof. The insert has a width and thickness of 0.010" to 0.015" and is usually laser welded into a stamped-out portion of the firing surface 60 on the ground electrode 12B and firing surface 62 of the center electrode 18B. Alternatively, the center electrode 18B firing surface 62 can be coated 66 with a precious metal alloy as shown in FIG. 28 instead of stamping out a surface for insertion of an insert.

The precious metal inserts can be forms of solids or assemblies, laminated or fused in place on a nickel alloy ground or center electrode. The ground electrode 12B is preferably 94 to 96% by weight nickel, together with 1.5–2.0% by weight chromium and 1.75 to 2.2% by weight manganese. The center electrode 18B is preferablely made from INCANOL 600 nickel around a copper center.

The methods of attaching the precious metal insert also can be by tungsten inert gas welding, gas metal arc welding, resistance welding, laser welding, electron-beam welding, electrogas gas welding, capacitor discharge stud welding, friction welding, fusion bonding, hot isostatic pressure welding, thermo welding, pressure gas welding, carbon arc welding, atomic hydrogen welding, plasma arc welding, high frequency welding or laser spike seam welding. Laser welding is preferred.

The addition of a precious metal insert to the ground and center electrode enhances spark plug life to up to 100,000 miles, improves fuel economy, reduces emissions of toxic materials, eliminates cold starting pollution, substantially eliminates fouling of the spark plug, provides a coil effect to reduce resistance between the ground and center electrode and prevents misfires.

If the center electrode 18B for automotive use is capped 66 with a precious metal, it is preferred to employ a thickness of 0.005" to 0.030" with a cap diameter of 0.090" to 0.110". Most preferred is a thickness of 0.010" to 0.015".

The improved spark plug of this invention can be used in conventional internal combustion engines for automobiles, boats, airplanes, lawn mowers and like articles of manufacture. It also improves horsepower in dual plug cylinders and in combustion chambers with enhanced turbulence.

Having thus described the invention, what is claimed and desired to be secured by Letters Patent is:

1. In an internal combustion engine spark plug having a metal housing at least partially enclosing an insulator containing a conductive center electrode, the center electrode having a bottom portion in the form of a solid cylinder with a planar surface at an end distal from the insulator, the center electrode extending from the insulator at a bottom end of the spark plug, the bottom end of the center electrode being vertically spaced by at least 0.015 inches from a top surface of a ground electrode attached to the metal housing, the improvement wherein the ground electrode has a ring shaped firing portion attached to the metal housing by at least one integral mounting post, the top surface of the ring shaped firing portion of the ground electrode being fixed at a distance from and parallel to the bottom planar surface of the center electrode, an inner annular uniform circumference of the ground electrode being concentric with the center electrode, a firing surface of the ground electrode containing a precious metal insert selected from the group consisting of platinum, palladium, iridium or an alloy thereof, and a firing pattern from the center electrode forming an annular ring pattern around the top of the ground electrode firing portion.

2. The improved spark plug according to claim 1 wherein the ring shaped ground electrode and at least one integral mounting post are integral with a mounting ring, the mounting ring being in a plane parallel to the ring shaped ground electrode and vertically spaced by at least one mounting post.

3. The improved spark plug according to claim 1, wherein the center electrode bottom planar firing surface contains a precious metal selected from the group consisting of platinum, palladium, iridium or an alloy thereof.

4. The improved spark plug according to claim 3 wherein the firing surface of the ground electrode and center electrode contains the precious metal insert laser welded in place.

5. The improved spark plug according to claim 1 wherein at least one opposed firing surface from the ground or center electrode contains the precious metal insert laser welded in place.

6. The improved spark plug according to claim 1 wherein the ring shape of the ground electrode has a discontinuity of up to 90°.

7. The improved spark plug according to claim 1 wherein the ground electrode is supported by one mounting post and the discontinuity is located at a point distal from the post.

8. The improved spark plug according to claim 1 wherein the inner diameter of the ring shaped ground electrode is from 0.80 to 1.25 times the outer diameter of the center electrode.

9. The improved spark plug according to claim 1 wherein the inner diameter of the ring shaped ground electrode is 0.015 inches more than the outer diameter of the center electrode.

10. The improved spark plug according to claim 1 wherein there are three mounting posts.

* * * * *